US006048178A

United States Patent [19]

Kawaguchi et al.

[11] Patent Number: 6,048,178

[45] Date of Patent: Apr. 11, 2000

[54] COMPRESSOR

[75] Inventors: Masahiro Kawaguchi; Masanori Sonobe; Yoshihiro Makino; Ken Suitou, all of Kariya, Japan

[73] Assignee: Kabushiki Kaisha Toyoda Jidoshokki, Kariya, Japan

[21] Appl. No.: 09/042,548

[22] Filed: Mar. 17, 1998

[30] Foreign Application Priority Data

Mar. 31, 1997 [JP] Japan ..... 9-080402

[51] Int. Cl.[7] ..... F04B 1/26

[52] U.S. Cl. ..... 417/222.2; 417/269; 417/569

[58] Field of Search ..... 417/222.2, 213, 417/269, 569, 571, 566, 360; 137/855, 516.11

[56] References Cited

U.S. PATENT DOCUMENTS

| | | | |
|---|---|---|---|
| 4,950,132 | 8/1990 | Brian, Jr. et al. | 417/269 |
| 4,963,074 | 10/1990 | Sanuki et al. | 417/222 |
| 5,145,326 | 9/1992 | Kimura et al. | 417/222.2 |
| 5,165,863 | 11/1992 | Taguchi | 417/222.2 |
| 5,531,572 | 7/1996 | Kimura et al. | 417/222.2 |
| 5,586,870 | 12/1996 | Kawaguchi et al. | 417/222.2 |
| 5,702,235 | 12/1997 | Hirota et al. | 417/222.2 |
| 5,785,502 | 7/1998 | Ota et al. | 417/222.2 |
| 5,971,716 | 10/1999 | Ota et al. | 417/222.2 |
| 5,975,859 | 11/1999 | Kawaguchi et al. | 417/222.2 |

FOREIGN PATENT DOCUMENTS

| | | |
|---|---|---|
| 3900234 A1 | 7/1989 | Germany . |
| 3904240 A1 | 8/1989 | Germany . |
| 8-109877 | 4/1996 | Japan . |

*Primary Examiner*—Teresa Walberg
*Assistant Examiner*—Vinod D Patel
*Attorney, Agent, or Firm*—Woodcock Washburn Kurtz Mackiewicz & Norris LLP

[57] ABSTRACT

A compressor has a control valve that adjusts the pressure difference between a crank chamber and a cylinder bore for controlling the inclination of a drive plate. The control valve protrudes outward from the compressor housing. The compressor also has a support protruding outward from the front housing and a leg protruding outward from the cylinder block. The outer ends of the support and the leg extend further from the compressor than the furthest extremity the control valve. Therefore, when the compressor is placed on a flat surface, the support and the leg prevent the control valve from contacting the surface. This protects the control valve from damage during transport and handling.

20 Claims, 5 Drawing Sheets

COMPRESSOR

BACKGROUND OF THE INVENTION

The present invention relates to compressors that are used in vehicle air conditioners. More particularly, the present invention relates to a compressor that includes a valve device such as a control valve for controlling displacement of the compressor.

A typical variable displacement compressor includes a drive shaft that is rotatably supported in its housing. The housing includes a cylinder block having cylinder bores. Each cylinder bore reciprocally houses a piston. A crank chamber is also defined in the housing. The crank chamber accommodates a swash plate. The swash plate is supported on the drive shaft to rotate integrally with and to tilt with respect to the drive shaft. Rotation of the swash plate reciprocates the pistons thereby causing the pistons to draw refrigerant gas from a suction chamber into the cylinder bores and to compress the gas. The pistons then discharge the compressed gas from the cylinder bores to a discharge chamber.

The discharge chamber is connected with the crank chamber by a supply passage. The supply passage includes a displacement control valve. The control valve regulates the supply passage for controlling the amount of refrigerant gas supplied from the discharge chamber to the crank chamber thereby controlling the pressure in the crank chamber. Changes in the pressure in the crank chamber alter the pressure difference between the crank chamber and the cylinder bores. The alteration of the pressure difference changes the inclination of the swash plate. Accordingly, the displacement of the compressor is varied.

The control valve typically protrudes from the lower side of the compressor housing so that the control valve does not interfere with other parts in the compressor or with other devices in the engine compartment. However, if the compressor is carelessly placed on a surface, for example, of a workbench, the lower end of the control valve contacts the surface. The weight of the compressor acts on the control valve and may deform the control valve. The deformation may cause the valve to malfunction. Further, the control valve can be loosened with respect to a corresponding recess in the compressor housing. This may cause the pressure in the compressor to leak to the outside. Thus, during storage or transport, an assembled compressor needs to be placed on a supporting tool or in a transport case such that the control valve does not contact a surface, which makes the handling of the compressor troublesome.

SUMMARY OF THE INVENTION

Accordingly, it is an objective of the present invention to provide a compressor that has a simple structure for preventing a valve device protruding from the housing from contacting a surface on which the compressor is placed.

To achieve the foregoing and other objectives and in accordance with the purpose of the present invention, a compressor for compressing gas is provided. The compressor includes a housing and a valve mechanism for controlling the gas flow in the housing. The valve mechanism is installed in the housing such that a part of the valve mechanism protrudes from the housing. The compressor also includes a member for preventing the valve mechanism from contacting a flat surface when the compressor is placed on the flat surface.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A variable displacement compressor according to one embodiment of the present invention will be described with reference to FIGS. 1 to 4.

Figure 1:
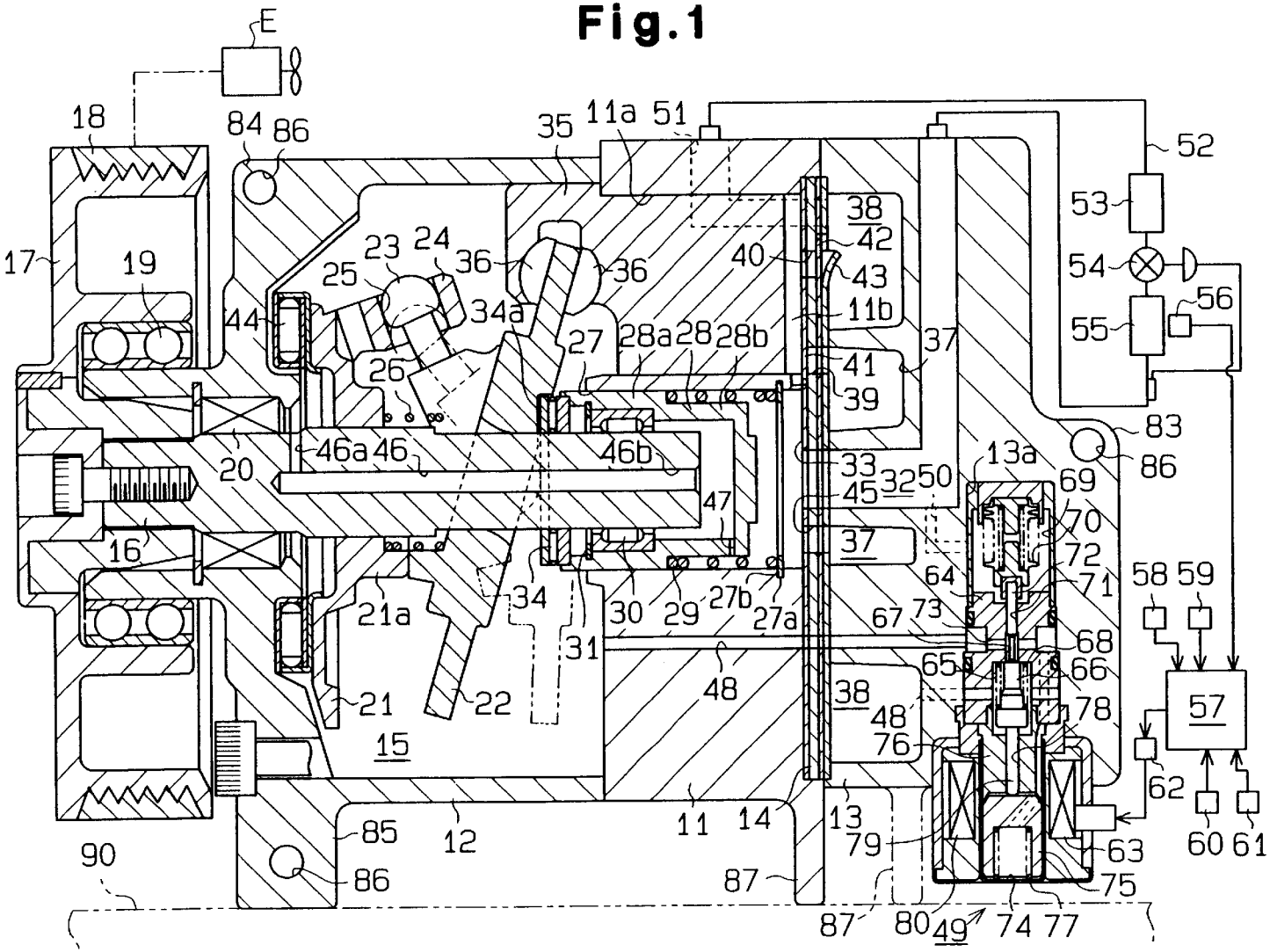
FIG. 1 is a diagrammatic cross-sectional view illustrating a compressor according to one embodiment of the present invention (for convenience, the valve is shown as if its axis were in the cross-sectional plane)

As shown in FIG. 1, a front housing 12 is secured to the front end face of a cylinder block 11. A rear housing 13 is secured to the rear end face of the cylinder block 11 with a valve plate 14. The cylinder block 11, the front housing 12 and the rear housing 13 constitute a compressor housing. The compressor housing is molded with aluminum of aluminum alloy.

The inner walls of the front housing 12 and the front end face of the cylinder block 11 define a crank chamber 15. A drive shaft 16 is rotatably supported in the front housing 12 and the cylinder block 11 and extends through the crank chamber 15. The front end of the drive shaft 16 protrudes from the crank chamber 15 and is secured to a pulley 17. The pulley 17 is directly coupled to an external drive source (an engine E) by a belt 18. The compressor of this embodiment is referred to as a clutchless type variable displacement compressor, since it is not clutched on and off.

The pulley 17 is supported by the front housing 12 with an angular bearing 19. The angular bearing 19 transfers thrust and radial loads that act on the pulley 17 to the front housing 12.

A lip seal 20 is located between the drive shaft 16 and the front housing 12 for sealing the crank chamber 15. That is, the lip seal 20 prevents refrigerant gas in the crank chamber 15 from leaking outside.

A disk-like swash plate 22 is supported by the drive shaft 16 in the crank chamber 15 to slide along and to tilt with respect to the axis of the shaft 16. The swash plate 22 functions as a drive plate. A pair of guiding pins 23 are fixed to the swash plate 22. Each guiding pin 23 has a guide ball at its distal end. A rotor 21 is fixed to the drive shaft 16 in the crank chamber 15 to rotate integrally with the drive shaft 16. The rotor 21 has a support arm 24 protruding toward the swash plate 22. A pair of guide holes 25 are formed in the support arm 24. Each guide pin 23 is slidably fitted into the corresponding guide hole 25. The support arm 24 and the guide pins 23 constitute a hinge mechanism. The cooperation of the arm 24 and the guide pins 23 permits the swash plate 22 to rotate integrally with the drive shaft 16. The cooperation also guides the tilting of the swash plate 22 and the sliding of the swash plate 22 along the axis of the drive shaft 16. The inclination of the swash plate 22 decreases as it slides rearward toward the cylinder block 11.

A coil spring 26 is located between the rotor 21 and the swash plate 22. The spring 26 urges the swash plate 22 rearward, or in a direction to decrease the inclination of the swash plate 22. The rotor 21 has a projection 21*a* on its rear end face. Abutment of the swash plate 22 against the projection 21*a* limits the maximum inclination of the swash plate 22.

Figure 3:
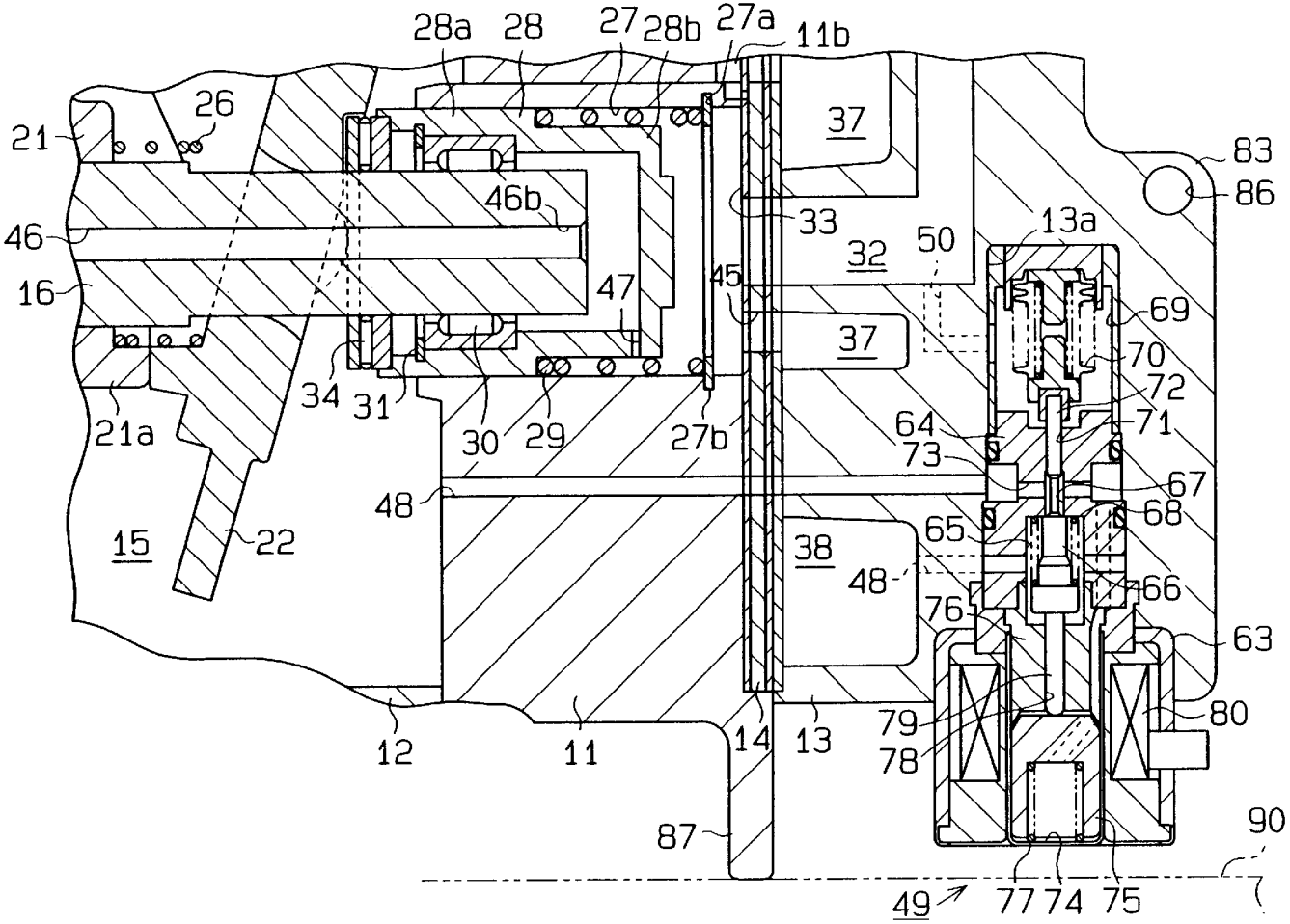
FIG. 3 is an enlarged partial cross-sectional view illustrating the compressor of FIG. 1 when the inclination of the swash plate is maximum (for convenience, the valve is shown as if its axis were in the cross-sectional plane)
Figure 4:
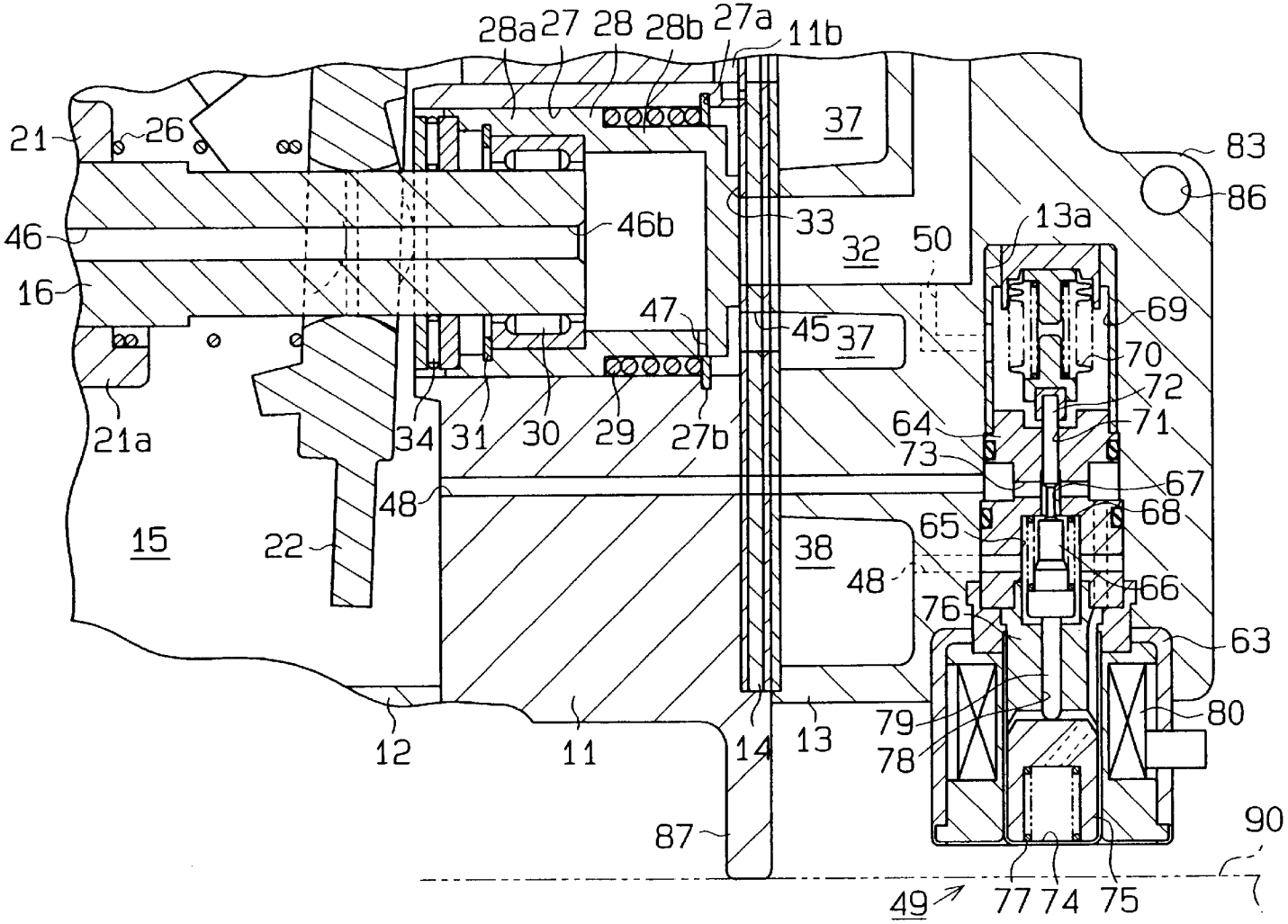
FIG. 4 is an enlarged partial cross-sectional view illustrating the compressor of FIG. 1 when the inclination of the swash plate is minimum (for convenience, the valve is shown as if its axis were in the cross-sectional plane)
Figure 5:
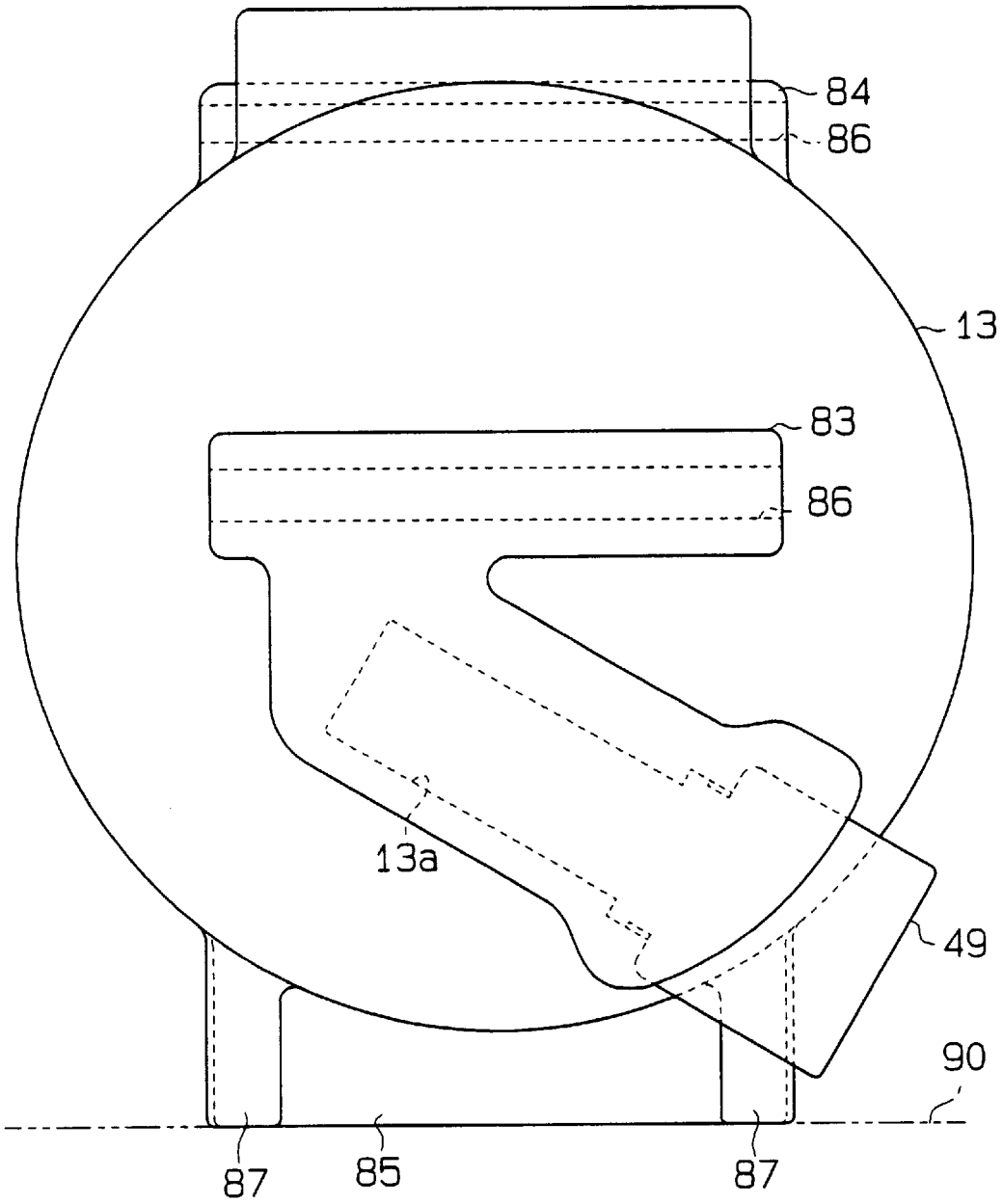
FIG. 5 is a diagram like FIG. 2 of a compressor according to another embodiment.

As shown in FIGS. 3 and 4, the cylinder block 11 has a shutter chamber 27 at its center portion. The shutter chamber 27 extends along the axis of the drive shaft 16 and has a constant diameter along its longitudinal direction. A hollow cylindrical shutter 28 with a closed end is slidably accommodated in the shutter chamber 27. When installing the shutter 28 in the shutter chamber 27, the shutter 28 is inserted in the chamber 27 from the rear end of the cylinder block 11 (right side as viewed in FIG. 1). The shutter 28 has a large diameter portion 28*a* and a small diameter portion 28*b*.

The rear end of the drive shaft 16 is inserted in the shutter 28. A radial bearing 30 is fixed to the inner wall of the large diameter portion 28*a* of the shutter 28 by a snap ring 31. Therefore, the radial bearing 30 moves with the shutter 28 along the axis of the drive shaft 16. The rear end of the drive shaft 16 is supported by the inner wall of the shutter chamber 27 with the radial bearing 30 and the shutter 28 in between.

An annular groove 27*a* is formed in the rear part of the shutter chamber 27. A snap ring 27*b* is detachably fitted in the groove 27*a*. A coil spring 29 is located between a step, which is defined by the large diameter portion 28*a* and the small diameter portion 28*b*, and the snap ring 27*b*. The coil spring 29 urges the shutter 28 toward the swash plate 22. The urging force of the spring 29 is smaller than that of the spring 26.

A suction passage 32 is defined at the center portion of the rear housing 13 and the valve plate 14. The inner end of the passage 32 communicates with the shutter chamber 27. A positioning surface 33 is formed on the valve plate 14 about the inner opening of the suction passage 32. The rear end of the shutter 28 abuts against the positioning surface 33. Abutment of the shutter 28 against the positioning surface 33 prevents the shutter 28 from further moving rearward away from the rotor 21. The abutment also disconnects the suction passage 32 from the shutter chamber 27.

A thrust bearing 34 is supported on the drive shaft 16 and is located between the swash plate 22 and the shutter 28. The thrust bearing 34 slides along the axis of the drive shaft 16. The force of the spring 29 constantly retains the thrust bearing 34 between the swash plate 22 and the shutter 28. The thrust bearing 34 prevents the rotation of the swash plate 22 from being transmitted to the shutter 28.

The cylinder block 11 has cylinder bores 11*a* extending therethrough. The cylinder bores 11*a* are located about the axis of the drive shaft 16. Each cylinder bore 11*a* accommodates a single-headed piston 35. Each piston 35 is operably coupled to the swash plate 22 by a pair of shoes 36. The end of each piston 35 and the valve plate 14 define a compression chamber 11*b*. Rotation of the drive shaft 16 is transmitted to the swash plate 22 by the rotor 21. The rotation of the swash plate 22 is converted to linear reciprocation of each piston 35 in the associated cylinder bore 11*a* through the shoes 36.

The rear housing 13 includes an annular suction chamber 37 and an annular discharge chamber 38. The discharge chamber 38 is defined about the suction chamber 37. The valve plate 14 has suction ports 39 and discharge ports 40. Each suction port 39 and each discharge port 40 correspond to one of the cylinder bores 11*a*. The valve plate 14 has suction valve flaps 41 and discharge valve flaps 42. Each suction valve flap 41 corresponds to one of the suction ports 39 and each discharge valve flap 42 corresponds to one of the discharge ports 40. The valve plate 14 has retainers 43. Each retainer 43 corresponds to one of the discharge valve flaps 42.

As each piston 35 moves from the top dead center to the bottom dead center in the associated cylinder bore 11*a*, refrigerant gas in the suction chamber 37 enters the cylinder bore 11*a* through the associated suction port 39 while causing the associated suction valve flap 41 to flex to an open position. As each piston 35 moves from the bottom dead center to the top dead center in the associated cylinder bore 11*a*, refrigerant gas is compressed in the cylinder bore 11*a* and is discharged to the discharge chamber 38 through the associated discharge port 40 while causing the associated discharge valve flap 42 to flex to an open position. The opening amount of each discharge valve flap 42 is defined by contact between the valve flap 42 and the associated retainer 43.

A thrust bearing 44 is located between the front housing 12 and the rotor 21. The thrust bearing 44 carries the reactive force of gas compression acting on the rotor 21 through the pistons 35 and the swash plate 22.

The suction chamber 37 is connected with the shutter chamber 27 by a hole 45. When contacting the positioning surface 33, the shutter 28 closes the suction passage 32 thereby disconnecting the hole 45 from the suction passage 32.

As shown in FIG. 1, the drive shaft 16 has an axial passage 46. The passage 46 has an inlet 46*a* and an outlet 46*b*. The inlet 46*a* opens to the crank chamber 15 in the vicinity of the lip seal 20 and the outlet 46*b* opens to the interior of the shutter 28. The interior of the shutter 28 is connected with the shutter chamber 27 by a pressure release hole 47, which is formed in the shutter wall near the rear end of the shutter 28.

Figure 2:
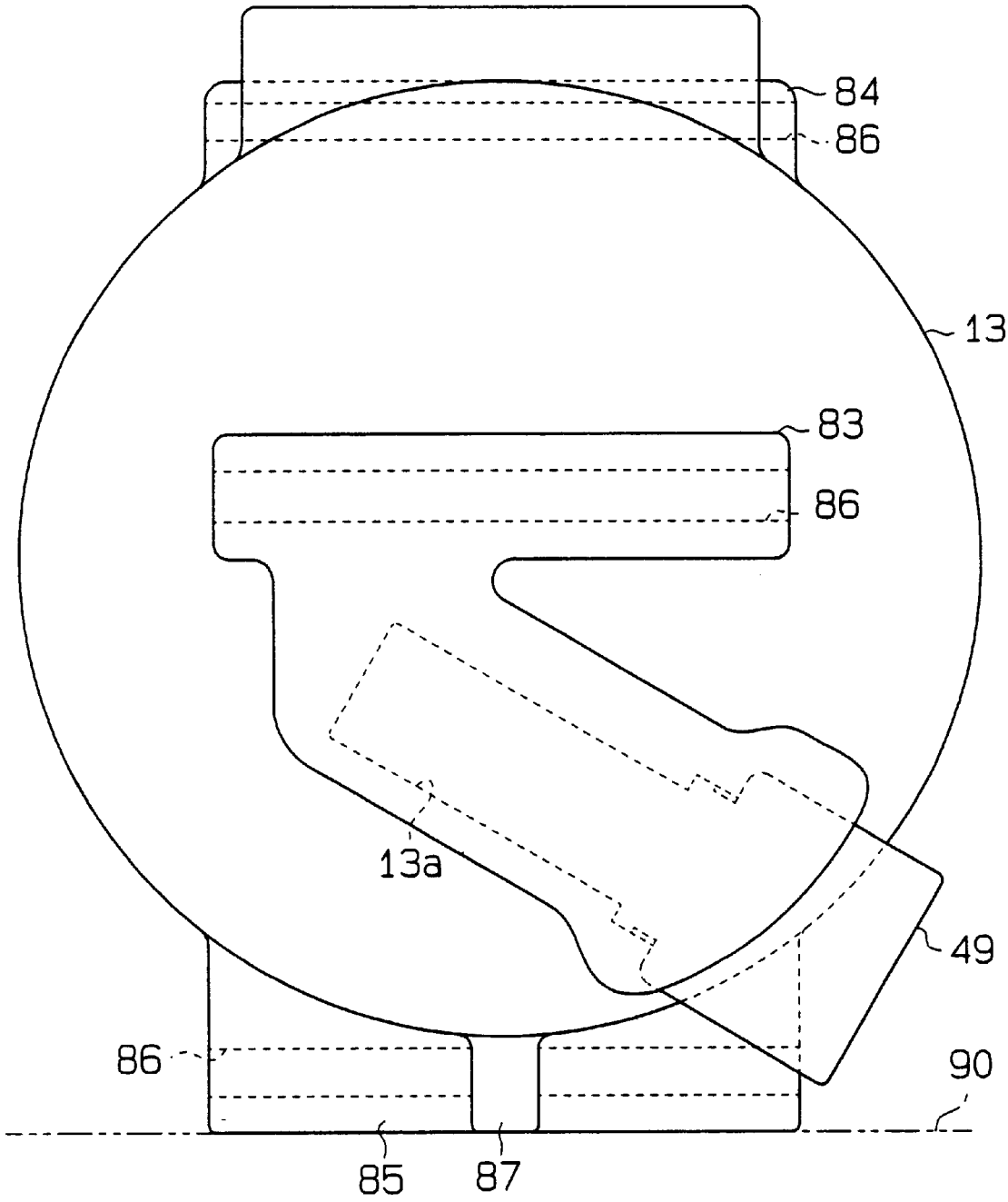
FIG. 2 is a diagram of the compressor of FIG. 1 as viewed from the right side of FIG. 1.

The discharge chamber 38 is connected with the crank chamber 15 by a supply passage 48 defined in the rear housing 13, the valve plate 14 and the cylinder block 11. The supply passage 48 is regulated by a displacement control valve 49 accommodated in the rear hosing 13. Specifically, the control valve 49 is fitted in a valve recess 13*a*, which is formed in the rear housing 13. As shown in FIG. 2, the lower portion of the control valve 49 protrudes from the lower side of the rear housing 13 in an inclined manner. For ease of illustration, FIGS. 1 and 3 show the control valve 49 as if its longitudinal axis were in the vertical cross sectional plane of the drawings, however, FIG. 2 shows the actual orientation of the valve 49. The control valve 49 is connected with the suction passage 32 by a pressure introduction passage 50 formed in the rear housing 13. The passage 50 introduces suction pressure to the control valve 49.

An outlet 51 is formed in the cylinder block 11 and communicates with the discharge chamber 38. The outlet port 51 is connected to the suction passage 32 by an external refrigerant circuit 52. The refrigerant circuit 52 includes a condenser 53, an expansion valve 54 and an evaporator 55. The expansion valve 54 is a temperature controlled automatic expansion valve that controls the flow rate of refrigerant in accordance with the temperature of refrigerant gas at the outlet of the evaporator 55. A temperature sensor 56 is located in the vicinity of the evaporator 55. The temperature sensor 56 detects the temperature of the evaporator 55 and issues signals relating to the detected temperature to a computer 57. The computer 57 is also connected to a temperature adjuster 58, a compartment temperature sensor 59, an air conditioner starting switch 60 and an engine speed sensor 61. A passenger sets a desirable compartment temperature, or a target temperature, by the temperature adjuster 58.

The computer 57 receives various information including, for example, a target temperature set by the temperature adjuster 58, the temperature detected by the temperature sensor 56, the passenger compartment temperature detected by the temperature sensor 59, an ON/OFF signal from the starting switch 60 and the engine speed detected by the engine speed sensor 61. Based on this information, the computer 57 computes the value of a current supplied to a displacement control valve 49 and transmits the computed current value to a driver 62. The driver 62 sends a current having the value transmitted from the computer 57 to a solenoid 63 in the valve 49. The information for determining the current value for the valve 49 may include information other than that listed above, for example, the information may include the temperature outside of the vehicle.

As shown in FIGS. 1 and 3, the control valve 49 includes a housing 64 and the solenoid 63. The housing 64 and the solenoid 63 are secured to each other and define a valve chamber 65 in between. The valve chamber 65 accommodates a valve body 66 and is connected with the discharge chamber 38 by the upstream portion of the supply passage 48. The housing 64 also has a valve hole 67 extending along its axis. The lower opening of the valve hole 67 faces the valve body 66. The valve hole 67 is connected with the crank chamber 15 by the downstream portion of the supply passage 48. That is, the valve chamber 65 and the valve hole 67 constitute a part of the supply passage 48. A spring 68 extends between the valve body 66 and a wall of the valve chamber 65. The spring 68 urges the valve body 66 in a direction opening the valve hole 67.

A pressure sensing chamber 69 is defined in the upper portion of the control valve 49 on top of the housing 64. The sensing chamber 69 accommodates a bellows 70 and is connected with the suction passage 32 by the pressure introduction passage 50. A guide hole 71 is defined in the housing 64 between the pressure sensing chamber 69 and the valve hole 66. The bellows 70 is coupled to the valve body 66 by a pressure sensing rod 72. The rod 72 extends through and slides with respect to the guide hole 71. The rod 72 has a small diameter portion, which extends through the valve hole 67. A clearance between the small diameter portion of the rod 72 and the valve hole 67 permits the flow of refrigerant gas.

A port 73 is defined in the housing 64 between the valve chamber 65 and the pressure sensing chamber 69. The port 73 intersects the valve hole 67. The valve hole 67 is connected with the crank chamber 15 by the port 73 and the supply passage 48.

The solenoid 63 includes a plunger chamber 74. A fixed steel core 76 is press fitted in the upper opening of the plunger chamber 74. The plunger chamber 74 accommodates a cylindrical steel plunger 75, which slides with respect to the chamber 74. A spring 77 extends between the plunger 75 and the bottom of the plunger chamber 74. The urging force of the spring 77 is smaller than that of the spring 68.

The fixed core 76 has a guide hole 78 extending between the plunger chamber 74 and the valve chamber 65. A solenoid rod 79 is formed integrally with the valve body 66 and projects downward from the bottom of the valve body 66. The rod 79 extends through and slides with respect to the guide hole 78. The forces of the springs 68 and 77 causes the lower end of the rod 79 to constantly contact the plunger 75. In other words, the valve body 66 moves integrally with the plunger 75 with the rod 79 in between.

The solenoid 63 has a cylindrical coil 80, which is wound about the fixed core 76 and the plunger 75. The driver 62 provides the coil 80 with electric current based on commands from the computer 57. That is, the magnitude of the current supplied to the coil 80 is determined by the computer 57.

As shown in FIGS. 1–3, the rear housing 13 has a horizontal support 83 in the center of its rear end face. The support 83 is integrally formed with the rear housing 13. The front housing 12 has a horizontal support 84 in its top front portion. The support 84 extends perpendicular to the axis of the compressor. The front housing 12 also has a support 85 in its bottom front portion. The support 85 extends parallel to the support 84. The supports 84, 85 are integrally formed with the front hosing 12. Further, the supports 83, 84, 85 have holes 86 extending in their longitudinal directions. Fasteners such as bolts (not shown) are inserted in the holes 86 to fix the compressor to a supporting part, for example, a support within a vehicle's engine compartment.

As shown in FIGS. 1 and 2, the cylinder block 11 has a leg 87 protruding from its bottom rear portion. The lower end of the leg 87 and that of the support 85 are located lower than the lower end of the control valve 49, which protrudes from the lower side of the rear housing 13. When the compressor is placed on a surface 90, for example, of a workbench, the compressor is supported by the support 85 and the leg 87 and the control valve 49 does not contact the surface 90. That is, the support 85 and the leg 87 prevent the control valve 49 from contacting the surface 90.

The operation of the refrigerant circuit will now be described.

When the air conditioner starting switch 60 is on, if the temperature detected by the compartment temperature sensor 59 is higher than a target temperature set by the temperature adjuster 58, the computer 57 commands the driver 62 to excite the solenoid 63. Accordingly, the driver 62 actuates the coil 80 with electric current having a certain magnitude. The current produces a magnetic attractive force between the fixed core 76 and the plunger 75 in accordance with the current magnitude. The attractive force is transmitted to the valve body 66 by the solenoid rod 79 and thus urges the valve body 66 against the force of the spring 68 in a direction closing the valve hole 67. On the other hand, the length of the bellows 70 varies in accordance with the suction pressure in the suction passage 32 that is introduced to the pressure sensing chamber 69 via the pressure introduction passage 50. The changes in the length of the bellows 70 are transmitted to the valve body 66 by the rod 72.

The opening area between the valve body 66 and the valve hole 67 is determined by the equilibrium of forces acting on the valve body 66. Specifically, the opening area is determined by the equilibrium position of the body 66, which is affected by the force of the solenoid 63, the force of the bellows 70 and the force of the spring 68.

When the cooling load is great, the suction pressure is high and the temperature in the vehicle compartment detected by the sensor 59 is higher than a target temperature set by the temperature adjuster 58. The computer 57 commands the driver 62 to increase the magnitude of the current sent to the coil 80 as the difference between the compartment temperature and the target temperature increases. A higher current magnitude increases the attractive force between the fixed core 76 and the plunger 75, thereby increasing the resultant force that causes the valve body 66 to close the valve hole 67. Accordingly, the pressure required for moving the valve body 66 in a direction closing the valve hole 67 is lowered. In this state, the valve body 66 changes the opening of the valve hole 67 in accordance with relatively low suction pressure. In other words, as the magnitude of the current to the control valve 49 is increased, the valve 49 functions to maintain the pressure (the target suction pressure) at a lower level.

A smaller opening area between the valve body 66 and the valve hole 67 represents a decreased refrigerant gas flow from the discharge chamber 38 to the crank chamber 15 via the supply passage 48. The refrigerant gas in the crank chamber 15 flows into the suction chamber 37 via the axial passage 46 and the pressure release hole 47. This lowers the pressure in the crank chamber 15. Further, when the cooling load is great, the suction pressure is high. Accordingly, the pressure in each compression chambers 11*b* is high. Therefore, the pressure difference between the crank chamber 15 and the compression chambers 11*b* is small. A smaller pressure difference between the crank and compression chambers 15, 11*b* increases the inclination of the swash plate 22, thereby causing the compressor to operate at a large displacement.

When the valve body 66 completely closes the valve hole 67, the supply passage 48 is closed. In this state, highly pressurized refrigerant gas in the discharge chamber 38 is not supplied to the crank chamber 15. Therefore, the pressure in the crank chamber 15 becomes substantially equal to the low pressure in the suction chamber 37. This maximizes the inclination of the swash plate 22 as shown in FIGS. 1 and 3, thereby causing the compressor to operate at the maximum displacement. The abutment of the swash plate 22 against the projection 21*a* of the rotor 21 limits the maximum inclination of the swash plate 22.

When the cooling load is small, the suction pressure is low and the difference between the compartment temperature detected by the sensor 59 and a target temperature set by the temperature adjuster 58 is small. The computer 57 commands the driver 62 to decrease the magnitude of the current sent to the coil 80 as the difference between the compartment temperature and the target temperature becomes smaller. A lower current magnitude decreases the attractive force between the fixed core 76 and the plunger 75 thereby decreasing the resultant force that moves the valve body 66 in a direction closing the valve hole 67. This raises the suction pressure required for moving the valve body 66 in a direction to close the valve hole 67. In this state, the valve body 66 changes the opening of the valve hole 67 in accordance with relatively high suction pressure. In other words, as the magnitude of the current to the control valve 49 is decreased, the valve 49 functions to maintain the suction pressure (target suction pressure) at a higher level.

A larger opening area between the valve body 66 and the valve hole 67 increases the amount of refrigerant gas flow from the discharge chamber 38 to the crank chamber 15. The increased gas flow increases the pressure in the crank chamber 15. Further, when the cooling load is small, the suction pressure is low and the pressure in the compression chambers 11*b* is low. Therefore, the pressure difference between the crank chamber 15 and the compression chambers 11*b* is great. A greater pressure difference between the crank and compression chambers 15, 11*b* decreases the inclination of the swash plate 22. Accordingly, the compressor operates at a small displacement.

As the cooling load approaches zero, the temperature of the evaporator 55 drops to a frost forming temperature. When the temperature sensor 56 detects a temperature that is equal to or lower than the frost forming temperature, the computer 57 commands the driver 62 to de-excite the solenoid 63. The driver 62 stops sending current to the coil 80, accordingly. This stops the magnetic attractive force between the fixed core 75 and the plunger 75. The valve body 66 is then moved by the force of the spring 68 against the force of the spring 77, which is transmitted by the plunger 75 and the solenoid rod 79, as illustrated in FIG. 4. In other words, the valve body 66 is moved in a direction to open the valve hole 67. This maximizes the opening area between the valve body 66 and the valve hole 67. Accordingly, the gas flow from the discharge chamber 38 to the crank chamber 15 is increased. This further raises the pressure in the crank chamber 15, thereby minimizing the inclination of the swash plate 22. The compressor thus operates at the minimum displacement.

When the switch 60 is turned off, the computer 57 commands the driver 62 to de-excite the solenoid 63. Accordingly, the inclination of the swash plate 22 is minimized.

As described above, when the magnitude of the current to the coil 80 is increased, the valve body 66 functions such that the opening of the valve hole 67 is closed by a lower suction pressure. When the magnitude of the current to the coil 80 is decreased, on the other hand, the valve body 66 functions such that the opening of the valve hole 67 is closed by a higher suction pressure. The compressor changes the inclination of the swash plate 22 to adjust its displacement thereby maintaining the suction pressure at a target value. The functions of the control valve 49 include changing the target value of the suction pressure in accordance with the magnitude of the supplied current. Another function of the valve 49 is maximizing the opening area of the valve hole 67 thereby allowing the compressor to operate at the minimum displacement at any given suction pressure. The compressor, which is equipped with the control valve 49 having such functions, varies the refrigeration level of the refrigerant circuit.

As its inclination decreases, the swash plate 22 moves rearward and pushes the shutter 28 rearward with the thrust bearing 34 toward the positioning surface 33 against the force of the spring 29. When the inclination of the swash plate 22 is minimum as illustrated in FIG. 4, the shutter 28 abuts against the positioning surface 33. The abutment limits the minimum inclination of the swash plate 22 and disconnects the suction passage 32 from the shutter chamber 27. Therefore, refrigerant gas does not flow into the compressor from the external refrigerant circuit 52. In other words, the circulation of refrigerant gas between the circuit 52 and the compressor is stopped.

The minimum inclination of the swash plate 22 is slightly larger than zero degrees. Zero degrees refers to the angle of the swash plate's inclination when it is normal to the axis of the drive shaft 16. Therefore, even if the inclination of the swash plate 22 is minimum, refrigerant gas in the compression chambers 11*b* is discharged to the discharge chamber 38 and the compressor operates at the minimum displacement. The refrigerant gas is discharged from the compression chambers 11*b* to the discharge chamber 38 and then enters the crank chamber 15 through the supply passage 48. The refrigerant gas in the crank chamber 15 is drawn back into the compression chambers 11*b* through the axial passage 46, the pressure release hole 47 and the suction chamber 37. That is, when the inclination of the swash plate 22 is minimum, refrigerant gas circulates within the compressor traveling through the discharge chamber 38, the supply passage 48, the crank chamber 15, the axial passage 46, the pressure release hole 47, the suction chamber 37 and the compression chambers 11*b*. This circulation of refrigerant gas allows lubricant oil contained in the gas to lubricate the moving parts of the compressor.

When the switch 60 is on and the inclination of the swash plate 22 is minimum, an increase in the compartment temperature increases the cooling load. In this case, if the temperature detected by the compartment temperature sensor 59 exceeds a target temperature set by the compartment temperature adjuster 58, the computer 57 commands the driver 62 to excite the solenoid 63 based on the detected temperature increase. The solenoid 63 closes the supply passage 48 thereby stopping the flow of refrigerant gas from the discharge chamber 38 to the crank chamber 15. Refrigerant gas in the crank chamber 15 flows to the suction chamber 37 through the axial passage 46 and the pressure release hole 47. Accordingly, the pressure in the crank chamber 15 is gradually lowered. The lowered crank chamber pressure moves the swash plate 22 from the minimum inclination to the maximum inclination.

As the inclination of the swash plate 22 is increased, the shutter 28 is gradually moved away from the positioning surface 33 by the force of the spring 29. This gradually enlarges the cross-sectional area of the passage between the suction passage 32 and the suction chamber 37. Accordingly, the amount of refrigerant gas flow from the suction passage 32 into the suction chamber 37 is gradually increased. Therefore, the amount of refrigerant gas that enters the compression chambers 11*b* from the suction chamber 37 is gradually increased. The displacement of the compressor and the discharge pressure are gradually increased, accordingly. The gradual increase of the discharge pressure gradually increases the torque for operating the compressor. In this manner, the torque of the compressor does not dramatically change in a short time when the displacement changes from the minimum to the maximum. This reduces the shock that accompanies load torque fluctuations.

If the engine E is stopped, the compressor is also stopped, that is, the rotation of the swash plate 22 is stopped, and the supply of current to the coil 80 in the control valve 49 is stopped. Therefore, the solenoid 63 is de-excited and opens the supply passage 48. Accordingly, the inclination of the swash plate 22 is minimized.

As mentioned in the Background section, compressors are often placed on a surface, for example, of a workbench or of a transport case. At this time, if the lower end of the control valve 49 protruding from the compressor 49 contacts the surface, the weight of the compressor can deform the valve 49. The deformation causes, for example, the solenoid rod 79 to be pressed against the wall of the guide hole 78. This hinders the sliding movement of the rod 79 in the guide hole 78. The computer 57 controls the opening of the control valve 49 by subtly changing the magnitude of the current supplied to the solenoid 63. Thus, the changes in the magnetic attractive force between the fixed core 75 and the plunger 76 are minute. Therefore, the hindered movement of the solenoid rod 79 results in inaccurate control of the valve 49. This ultimately causes inaccurate displacement control of the compressor. Further, the contact of the control valve 49 and the surface may loosen the valve 49 with respect to the valve recess 13*a*. This may cause refrigerant gas in the suction passage 32 or in the discharge chamber 38 to leak to the outside of the compressor.

However, the compressor of the embodiment of FIGS. 1 to 4 has the leg 87 and the support 85. The lower ends of the leg 87 and the support 85 are located lower than the lowest point of the control valve 49. Therefore, when the compressor is placed on the surface 90, as shown in FIG. 2, the compressor is supported by the support 85 and the leg 87 and the control valve 49 does not contact the surface 90. Thus, the previously mentioned drawbacks (the deformation of the control valve 49 and gas leakage) are avoided. Further, the embodiment of FIGS. 1 to 4 eliminates the necessity for specially designed supporting tools for protecting the valve 49 from a surface when storing assembled compressors. This embodiment also eliminates the necessity for special transport cases for separating the valve 49 from an adjacent surface when transporting assembled compressors.

The control valve 49 of this embodiment includes a pressure sensing mechanism having the solenoid 63 and the bellows 70. The solenoid 63 moves the valve body 66 based on commands from the computer 57 and the bellows 70 moves the valve body 66 based on changes in the suction pressure. This type of control valve tends to be large and thus protrudes from the lower side of the rear housing 13 by a relatively great amount. However, the construction of the present invention prevents the large control valve 49 from contacting a surface thereby assuring accurate displacement control of the compressor. In other words, the construction of the present invention is advantageous.

The control valve 49 is prevented from contacting a surface by simply forming the support leg 87 and the support 85 in the cylinder block 11 and the front housing 12. The support 85 also functions as a fastener for fixing to a support in the compressor in the engine compartment of a vehicle. Therefore, the construction of the compressor housing is simplified and easy to manufacture.

The support 85 is used for fastening the compressor to a place in a vehicle engine compartment. Therefore, the position of the support 85 with respect to the compressor is limited. On the other hand, the leg 87 is designed only for preventing the control valve 49 from contacting a surface. Therefore, the leg 87 may be located at any positions with respect to the compressor as long as it prevents the control valve 49 from contacting a surface. This adds to the flexibility of the design.

The support 85 and the legs 87 are integrally formed with the front housing 12 and the cylinder block 11. Specifically, the support 85 is molded integrally with the front housing 12 and the leg 87 is molded integrally with the cylinder block 11. This facilitates the formation of the support 85 and the leg 87 and reduces the number of parts.

The present invention may be alternatively embodied in the following forms:

As illustrated by double-dotted lines in FIG. 1, the leg 87 may be formed on the lower side of the rear housing 13. This structure increases the distance between the support 85 and the leg 87. In other words, the structure increases the distance between the support points of the compressor when the compressor is placed on the surface 90. The compressor is therefore more stable when placed on the surface 90.

Like the support 85, the support leg 87 may be elongated and extend perpendicular to the axis of the compressor. Alternatively, two or more legs 87 may be formed. In this case, the legs 87 are aligned with a line perpendicular to the axis of the compressor. This construction allows the compressor to be more stably placed on the surface 90.

Two or more short supports 85 may be formed. In this case the supports 85 are shorter than the support 85 in the illustrated embodiments and are aligned on a line perpendicular to the axis of the compressor. The holes 86 formed in the supports 85 are therefore aligned with each other. This structure reduces the amount of material that is used for forming the front housing 12 and the weight of the compressor compared to the case where the single support 85 of the illustrated embodiments is formed.

The support 85 may be divided into a fastening portion to fix the compressor and a leg for preventing the control valve 49 from contacting the surface 90.

Like the support 85, the leg 87 may function as fasteners for fixing the compressor.

The support 85 or the leg 87 may be formed separately from the compressor housing.

A bleeding passage may be formed in the compressor for connecting the crank chamber 15 with the suction chamber 37, and a displacement control valve may be located in the bleeding passage. The control valve controls the amount of refrigerant gas supplied to the suction chamber 37 from the crank chamber 15 thereby adjusting the pressure in the crank chamber 15. Accordingly, the pressure difference between the crank chamber 15 and the compression chambers 11*b* is changed. The changes in the pressure difference change the displacement of the compressor. In this case, a passage is preferably formed for constantly connecting the discharge chamber 38 with the crank chamber 15.

In the compressor of FIG. 1, the displacement is varied by changing the pressure in the crank chamber 15.

However, the displacement of the compressor may be varied in other manners. For example, the displacement may be varied by adjusting the pressure in the compression chambers 11*b* by controlling the amount of refrigerant gas supplied from the external refrigerant circuit 52 to the suction chamber 37.

A control valve for controlling the displacement of the compressor is not limited to the control valve 49. That is, the control valve 49 does not necessarily have both the solenoid 63 and a pressure sensing mechanism such as the bellows 70. For example, a control valve that only has a solenoid 63 may be used. In this case, the solenoid 63 actuates the valve body 66 based on commands from the computer 57. Alternatively, a control valve that only has a pressure sensing mechanism, which includes the bellows 70, may be used. In this case, the bellows 70 moves the valve body 66 based on changes in the suction pressure.

The above embodiments disclose constructions for preventing control valves in compressors from contacting a surface. However, the present invention is not limited to these constructions but may be employed for preventing other types of valves from contacting a surface. These valves include a check valve, which prevents refrigerant from flowing back to a compressor from an external refrigerant circuit, and a relief valve, which releases an abnormally high pressure in a compressor. Check valves and relief valves are used in many types of compressors including variable displacement compressors like the one illustrated in FIG. 1, double-headed piston type compressors, wobble plate type compressors, wave cam plate type compressors, scroll type compressors and vane-type compressors.

The present invention may be embodied in a variable displacement compressor in which the drive shaft 16 is coupled to the external drive source E with a clutch in between.

Therefore, the present examples and embodiments are to be considered as illustrative and not restrictive and the invention is not to be limited to the details given herein, but may be modified within the scope and equivalence of the appended claims.

What is claimed is:

1. A compressor for compressing gas comprising:

a housing;

a valve mechanism for controlling the gas flow in the housing, wherein the valve mechanism is installed in the housing such that a part of the valve mechanism protrudes from the housing; and a member for preventing the valve mechanism from contacting a flat surface when the compressor is placed on the flat surface.

2. The compressor according to claim 1, wherein a plurality of legs protrude further from the center of the housing than the furthest extremity of the valve mechanism.

3. The compressor according to claim 2, wherein the legs are integrally formed with the housing.

4. The compressor according to claim 2, wherein at least one of the legs functions as a fastener for fixing the compressor to a predetermined support.

5. The compressor according to claim 2, wherein the legs include a front leg located at a front portion of the compressor and a rear leg located at a rear portion of the compressor.

6. The compressor according to claim 5, wherein the housing includes a cylinder block and front and rear housing members that are secured to the cylinder block, and wherein the front leg is formed on the front housing and the rear leg is formed either on the cylinder block or on the rear housing member.

7. The compressor according to claim 6, wherein the rear leg is formed on the rear housing member for maximizing the distance between the front leg and the rear leg.

8. The compressor according to claim 5, wherein at least one of the front leg and the rear leg functions as a fastener structure for fixing the compressor to a predetermined support.

9. The compressor according to claim 8, wherein an axis of the fastener structure extends perpendicular to the axis of the housing.

10. The compressor according to claim 5, wherein at least one of the front leg and the rear leg comprises a plurality of projections aligned with a line perpendicular to the axis of the housing, and wherein the projections are spaced apart by predetermined intervals.

11. The compressor according to claim 1 further comprising:

a cylinder bore and a crank chamber that are defined in the housing;

a piston housed in the cylinder bore;

a drive shaft rotatably supported in the housing;

a drive plate tiltably supported on the drive shaft in the crank chamber, wherein the drive plate is operably coupled to the piston for converting rotation of the drive shaft into reciprocation of the piston, the drive plate tilts in accordance with pressure difference between the crank chamber and the cylinder bore, the piston moves with a stroke determined by the inclination of the drive plate thereby changing the displacement of the compressor; and the valve mechanism comprising a control valve that adjusts the pressure difference between the crank chamber and the cylinder bore for controlling the inclination of the drive plate.

12. A compressor comprising:

a housing including a cylinder bore and a crank chamber;

a piston housed in the cylinder bore;

a drive shaft rotatably supported in the housing;

a drive plate tiltably supported on the drive shaft in the crank chamber, wherein the drive plate is operably coupled to the piston for converting rotation of the drive shaft into reciprocation of the piston, the drive plate tilts in accordance with pressure difference between the crank chamber and the cylinder bore, the piston moves with a stroke determined by the inclination of the drive plate thereby changing the displacement of the compressor;

a control valve that adjusts the pressure difference between the crank chamber and the cylinder bore for controlling the inclination of the drive plate, wherein the control valve is installed in the housing such that a part of the control valve protrudes from the housing; and a plurality of legs protruding from the housing for preventing the control valve from contacting a flat surface when the compressor is placed on the flat surface, wherein the legs extend further from the center of the compressor than the furthest extremity of the control valve.

13. The compressor according to claim 12, wherein the legs are integrally formed with the housing.

14. The compressor according to claim 13, wherein the legs include a front leg located at a front portion of the compressor and a rear leg located at a rear portion of the compressor.

15. The compressor according to claim 14, wherein the housing includes a cylinder block and front and rear housing members that are secured to the cylinder block, and wherein the front leg is formed on the front housing and the rear leg is formed either on the cylinder block or on the rear housing member.

16. The compressor according to claim 15, wherein the rear leg is formed on the rear housing member for maximizing the distance between the front leg and the rear leg.

17. The compressor according to claim 15, wherein at least one of the front leg and the rear leg functions as a fastener structure for fixing the compressor to a predetermined support.

18. The compressor according to claim 17, wherein an axis of the fastener structure extends perpendicular to the axis of the housing.

19. The compressor according to claim 15, wherein at least one of the front leg and the rear leg comprises a plurality of projections aligned with a line perpendicular to the axis of the housing, and wherein the projections are spaced apart by predetermined intervals.

20. A compressor for compressing refrigerant gas comprising:

a housing having a center axis;

a valve mechanism for controlling the flow of refrigerant gas within the housing, wherein a protruding portion of the valve mechanism extends in a generally radial direction from the housing; and a leg member extending from the housing in a generally radial direction in close proximity to the protruding portion, such that the leg member extends further from the center axis of the housing than the furthest extremity of the protruding portion such that, if the compressor is rested on a flat surface using the leg member as a supporter, the protruding portion will not contact the flat surface.

* * * * *

UNITED STATES PATENT AND TRADEMARK OFFICE

CERTIFICATE OF CORRECTION

PATENT NO. : 6,048,178

DATED : April 11, 2000

INVENTOR(S) : Masahiro Kawaguchi, Masanori Sonobe, Yoshihiro Makino and Ken Suitou It is certified that error appears in the above-indentified patent and that said Letters Patent is hereby corrected as shown below:

On the title page, item [73], the correction should be "Kabushiki Kaisha Toyoda Jidoshokki Seisakusho", Kariya, Japan Signed and Sealed this Fifteenth Day of May, 2001

*Attest:*

Nicholas P. Godici

NICHOLAS P. GODICI

*Attesting Officer*

*Acting Director of the United States Patent and Trademark Office*